US010822899B2

(12) United States Patent
Burke et al.

(10) Patent No.: US 10,822,899 B2
(45) Date of Patent: Nov. 3, 2020

(54) SYSTEM AND METHOD FOR DISTRIBUTING LOADING IN LINER

(71) Applicant: SCHLUMBERGER TECHNOLOGY CORPORATION, Sugar Land, TX (US)

(72) Inventors: Travis Raymond Burke, Spring, TX (US); James Hall, Spring, TX (US); Raghavendar Ranganathan, Houston, TX (US); Srihari Chebolu, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 67 days.

(21) Appl. No.: 15/762,637

(22) PCT Filed: Sep. 23, 2016

(86) PCT No.: PCT/US2016/053235

§ 371 (c)(1),
(2) Date: Mar. 23, 2018

(87) PCT Pub. No.: WO2017/053651

PCT Pub. Date: Mar. 30, 2017

(65) Prior Publication Data

US 2018/0283117 A1 Oct. 4, 2018

Related U.S. Application Data

(60) Provisional application No. 62/233,042, filed on Sep. 25, 2015.

(51) Int. Cl.

| | |
|---|---|
| ***E21B 23/01*** | (2006.01) |
| ***E21B 43/10*** | (2006.01) |
| ***E21B 33/04*** | (2006.01) |

(52) U.S. Cl.
CPC ..... *E21B 23/01* (2013.01); *E21B 33/04* (2013.01); *E21B 43/10* (2013.01)

(58) Field of Classification Search
CPC ..... E21B 23/01; E21B 43/10; E21B 33/04
See application file for complete search history.

(56) References Cited

U.S. PATENT DOCUMENTS 3,912,006 A * 10/1975 Nutter ..... E21B 23/01 166/216
4,688,642 A * 8/1987 Baker ..... E21B 23/01 166/208

(Continued)

FOREIGN PATENT DOCUMENTS

WO 2009045995 A2 4/2009

OTHER PUBLICATIONS

Liner Hangers/Weatherford International, {https://www.weatherford.com/en/products-and-services/drilling/liner-systems/liner-hangers/} accessed Jan. 14, 2019, 15 pages.

*Primary Examiner* — Brad Harcourt
(74) *Attorney, Agent, or Firm* — Kelly McKinney

(57) ABSTRACT

A technique facilitates use of a liner hanger in a wide variety of environments by distributing loading. The liner hanger may comprise a liner hanger cone, e.g. an annular cone body, having a plurality of slots for receiving corresponding pipe-gripping slips. The slip slots and the corresponding pipe-gripping slips are staggered both longitudinally and circumferentially to distribute loading. An actuator may be used to shift the slips into gripping engagement with a surrounding pipe, e.g. casing, to improve the load distribution on the surrounding pipe and liner hanger cone once the liner is supported.

15 Claims, 6 Drawing Sheets

(56) References Cited

U.S. PATENT DOCUMENTS

| | | | | |
|---|---|---|---|---|
| 4,926,938 | A | 5/1990 | Lindsey, Jr. | |
| 5,906,240 | A | 5/1999 | Kilgore et al. | |
| 2014/0338892 | A1* | 11/2014 | Meador ..... | E21B 43/10 166/216 |

* cited by examiner

SYSTEM AND METHOD FOR DISTRIBUTING LOADING IN LINER

CROSS-REFERENCE TO RELATED APPLICATION

The present document is based on and claims priority to U.S. Provisional Application Ser. No. 62/233,042, filed Sep. 25, 2015, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing geologic formation. After a wellbore is drilled, various forms of well completion components may be installed to enable control over and to enhance efficiency of producing fluids from the reservoir. In some applications, a liner hanger and liner are deployed downhole into the wellbore, and the liner hanger is suspended from well casing deployed in the wellbore. The liner hanger may be hydraulically actuated to secure the liner hanger with respect to the casing by applying hydraulic pressure to an actuator mounted along a liner hanger body. The actuator drives slips into the surrounding casing to suspend and support the liner at least until the liner is cemented in the wellbore. The casing-gripping slips can create substantial force concentration.

SUMMARY

In general, a methodology and system facilitate use of a liner hanger in a wide variety of environments by distributing loading. The liner hanger may comprise a liner hanger cone, e.g. an annular cone body, having a plurality of slots for receiving corresponding pipe-gripping slips. The slip slots and the corresponding pipe-gripping slips may be staggered both longitudinally and circumferentially to distribute loading. An actuator may be used to shift the slips into gripping engagement with a surrounding pipe, e.g. casing, to improve the load distribution on the surrounding pipe and liner hanger cone once the liner is supported.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology able to facilitate use of a liner hanger in a wide variety of environments by distributing loading. The liner hanger may comprise a liner hanger cone, e.g. an annular cone body, having a plurality of slots which are staggered. For example, the slots may be staggered both longitudinally and circumferentially along the liner hanger cone. The slots are sized for receiving corresponding pipe-gripping slips such that both the slots and the corresponding pipe-gripping slips are staggered, thus enabling a distributed loading. An actuator may be used to shift the slips into gripping engagement with a surrounding pipe, e.g. casing. The staggered arrangement of slips improves the load distribution on the surrounding pipe and on the liner hanger cone once the liner is supported. The slips may engage the liner hanger cone along sloped surfaces, e.g. load ramps and/or guide splines, oriented to force the slips radially outwardly when moved in a longitudinal direction by the actuator.

According to an embodiment, the liner hanger comprises a liner hanger cone in the form of an annular body portion having first and second ends. A first band of slips is disposed near the first end of the annular body portion, and a second band of slips is disposed about the annular body portion proximate the first band of slips. However, the slips of the second band of slips are at a different longitudinal position and are circumferentially staggered relative to the slips of the first band of slips. The staggering of different groups of slips also provides an improved distribution of loading on the surrounding pipe, e.g. casing, when the liner hanger is set against the surrounding pipe.

Figure 1:
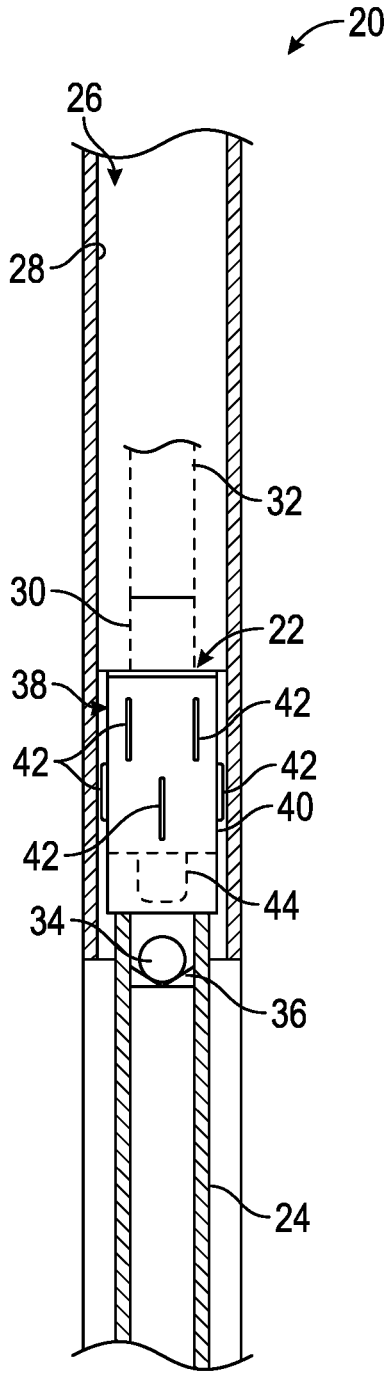
FIG. 1 is a schematic illustration of an example of a well system comprising a liner and a liner hanger deployed in a borehole, according to an embodiment of the disclosure.

Referring generally to FIG. 1, an embodiment of a well system 20 is illustrated as utilizing a liner hanger 22 to suspend a liner 24 in a borehole 26, e.g. a wellbore. By way of example, the wellbore 26 may be cased with a casing 28 and the liner hanger 22 may be secured to the casing 28, e.g. to a lower end of the casing 28. In the illustrated embodiment, the liner 24 and liner hanger 22 are deployed downhole into borehole 26 via a liner hanger running tool 30 coupled into a running string 32, e.g. a landing string. For example, the running string 32 may be in the form of a landing string comprising drill pipe.

As described in greater detail below, actuation of the liner hanger 22 into engagement with the surrounding surface/casing 28 may be achieved by applying pressure to a hydraulic actuating fluid delivered down through an interior of the running string 32. In some applications, a ball 34 may be dropped down through running string 32 and into a corresponding ball seat 36 to form a seal and to enable pressuring up within running string 32 and liner hanger 22. The ball 34 and/or ball seat 36 may then be removed, if desired, to enable fluid flow therethrough. It should be noted that ball 34 is illustrated as representative of a variety of drop-down tools which may be used to form the desired seal and ball 34 is not limited to devices in the form of a spherical ball. For example, ball 34 may comprise a variety of spheres or semi-spherical devices, darts, plugs, or other devices shaped and constructed to form the desired seal.

In the embodiment illustrated, the liner hanger 22 comprises a liner hanger cone 38 which may be in the form of an annular cone body 40. A plurality of slips 42 may be mounted along the liner hanger cone 38 for actuation via an actuator 44. The actuator 44 may be in the form of a piston actuator of the type used in various available liner hangers. By way of example, the actuator 44 is driven by hydraulic pressure during pressuring up within the running string 32 and the liner hanger 22. As the actuator 44 is shifted via hydraulic pressure, the slips 42 are driven longitudinally against the annular cone body 40 in a manner which forces the slips radially outward. Continued movement of the actuator 44 forces the slips 42 into gripping engagement with the surrounding surface, e.g. into engagement with the interior surface of casing 28.

The slips 42 may be staggered longitudinally, e.g. in the direction of wellbore 26, and/or circumferentially along the circumference of the annular cone body 40. In the illustrated example, a first band of the slips 42 is positioned longitudinally above a second band of the slips 42. Additionally, the second band of slips 42 is circumferentially staggered relative to the first band of slips 42. By way of example, slips 42 of the second band may be aligned generally along the center region between corresponding pairs of slips 42 of the first band. The longitudinal and/or circumferential staggering of the slips 42 distributes the loading along the interior of casing 28 when the liner hanger annular cone body 40 and suspended liner 24 are supported by the slips 42 after setting of the liner hanger 22.

In an operational example, the liner hanger 22 is run-in-hole and moved downhole along wellbore 26 to a desired location within casing 28. The liner hanger 22 is run-in-hole via running string 32, and then ball 34 is dropped into engagement with ball seat 36. This enables increased hydraulic pressure to be applied along the interior of running string 32 and liner hanger 22 so as to shift the actuator 44. The shifting actuator 44 drives slips 42 longitudinally and the liner hanger cone body 40 forces the slips 42 in a radially outward direction and into engagement with the surrounding surface of casing 28. Once the liner hanger 22 is set and the slips 42 engage casing 28, the load of the liner 24 transfers through the liner hanger cone body 40, through the slips 42, and into the casing 28. The staggered arrangement of slips 42 provides a distributed loading on the casing 28. It should be noted the liner hanger cone body 40 may have a variety of configurations and may be mounted on, for example, a hanger body, e.g. mandrel, as discussed in greater detail below.

After the liner hanger 22 is set and the loading is distributed through groups of staggered slips 42, the liner 24 may be cemented. Following the cementing operation, the running string 32 may be released from the liner hanger 22 by releasing running tool 30. In some embodiments, the running tool 30 is released from the inside diameter of a packer body. Once released, the running string 32 is retrieved up through a wellbore 26. In some applications, the liner hanger 22 may be part of a liner hanger assembly left downhole, and this assembly may include other components, e.g. a tieback receptacle, a packer, and/or other accessories.

Figure 2:
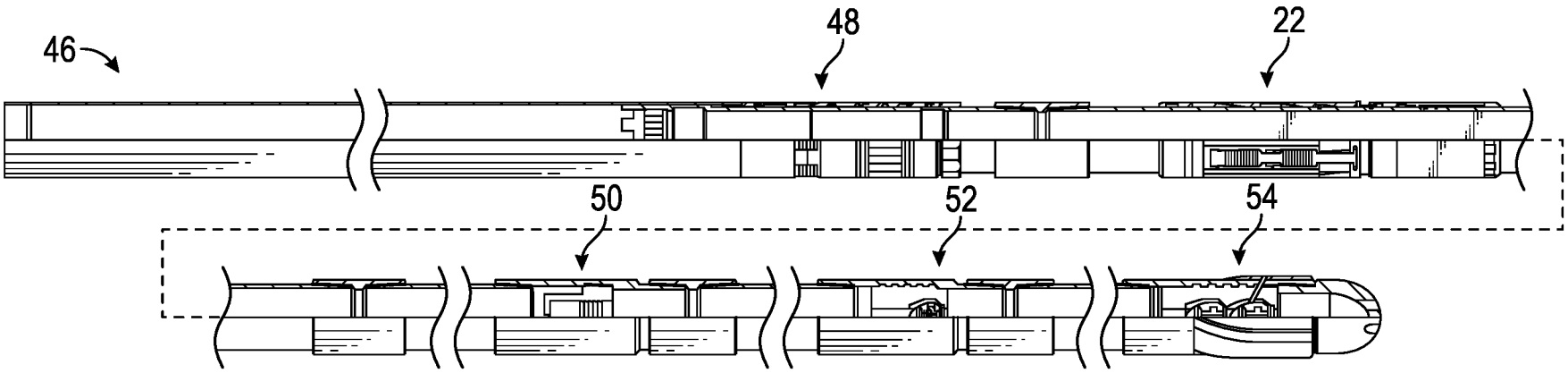
FIG. 2 is an illustration of an example of a liner hanger assembly which may be used with the well system illustrated in FIG. 1, according to an embodiment of the disclosure.
Figure 3:
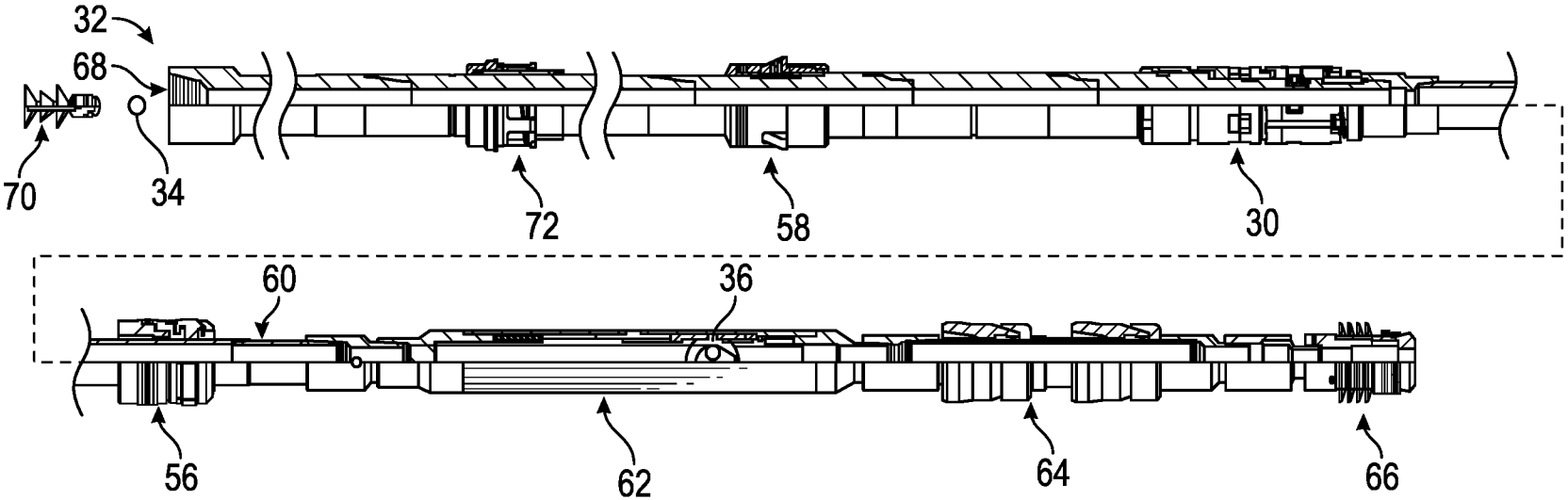
FIG. 3 is an illustration of an example of a running string for deploying the liner hanger assembly, according to an embodiment of the disclosure.

An example of a liner hanger system/assembly 46 incorporating liner hanger 22 is illustrated in FIG. 2. Additionally, an example of running string 32 with a variety of components is illustrated in FIG. 3. It should be noted, however, these figures provide examples and other applications may utilize additional and/or other components to provide a desired liner hanger system or running string.

Referring initially to FIG. 2, the illustrated example of liner hanger system 46 comprises liner hanger 22 positioned generally adjacent a top packer 48. The top packer 48 may be actuated to form a seal between the liner hanger system 46 and the surrounding casing 28. Examples of other components that may be combined with liner hanger 22 in system 46 include a landing collar 50, a float collar 52, and a reamer float shoe 54. However various other components may be utilized in liner hanger system 46 to facilitate a given well operation or operations.

In FIG. 3, an example of running string 32, including running tool 30, is illustrated. In this embodiment, the liner hanger running tool 30 is disposed between a retrievable cement bushing 56 and a rotating dog sub 58. The running string 32 also may comprise components such as a slick joint 60, a rotational ball seat sub 62, a swab cup assembly 64, and a liner wiper plug 66. The rotational ball seat sub 62 may comprise ball seat 36 used to receive and form a seal with ball 34. The running string 32 has an open internal passage 68 to accommodate movement of fluid and/or devices. For example, the open internal passage 68 enables the internal movement of devices such as ball 34 or a pump down plug 70. Depending on the application, the running string 32 may include a variety of other and/or additional features, such as the illustrated junk bonnet 72.

Figure 4:
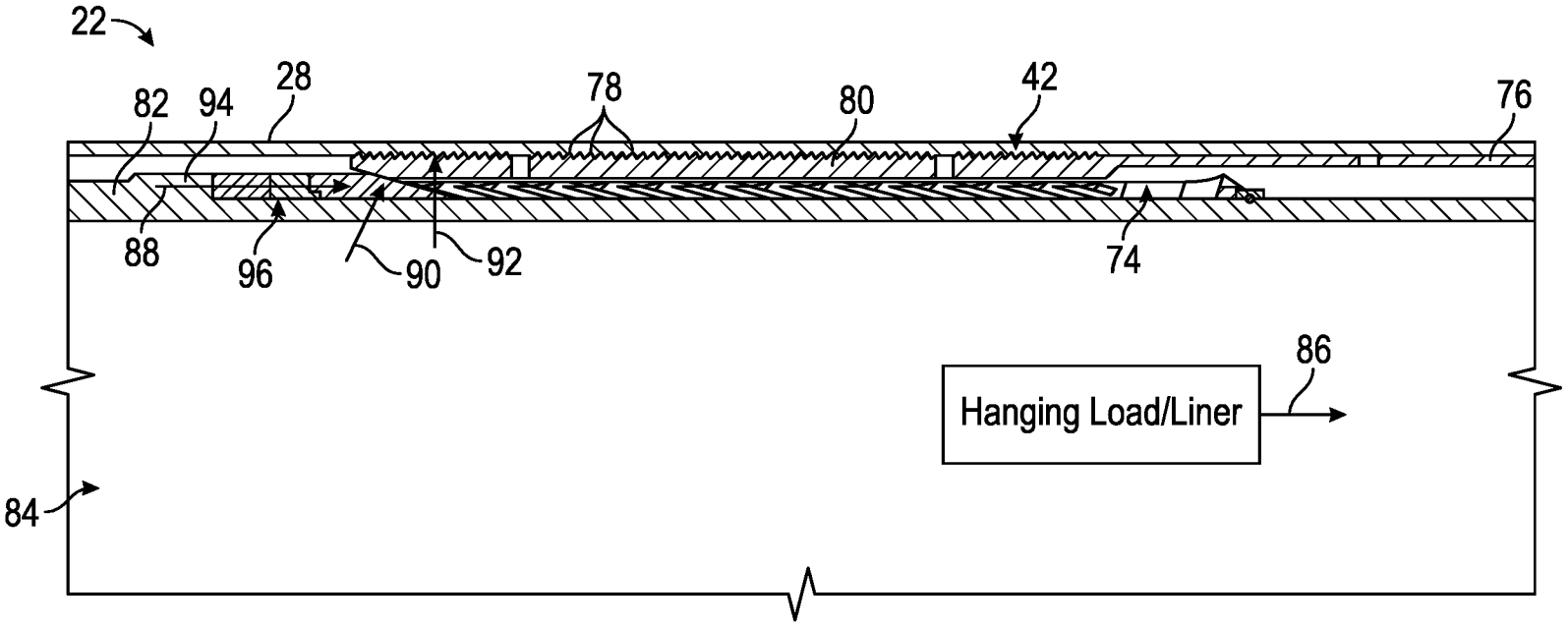
FIG. 4 is a cross-sectional illustration of part of an embodiment of a liner hanger which may be used in the well system illustrated in FIG. 1, according to an embodiment of the disclosure.

Referring generally to FIG. 4, a portion of an embodiment of liner hanger 22 is illustrated. In this example, the liner hanger 22 comprises annular cone body 40 which has a plurality of slots 74, e.g. radial slots therethrough, staggered both longitudinally and circumferentially. (See also FIG. 5). Slips 42 are located in the corresponding slots 74 and coupled with actuator 44 via slip arms 76.

According to an operational example, the running tool 30 of running string 32 is used to deploy liner hanger 22 and the overall liner hanger system 46 to the desired downhole location. The slips 42 may then actuated via hydraulic pressure and forced into engagement with the surrounding wall surface, e.g. into engagement with wellbore casing 28. As described above, ball 34 may be dropped down into sealing engagement with ball seat 36 to enable pressuring up within liner hanger 22. In the illustrated example, the liner hanger slips 42 are driven against corresponding features of annular cone body 40 by the actuator 44. As the liner hanger slips 42 are driven longitudinally by actuator 44, the annular cone body 40 forces gripping teeth 78 of slips 42 radially into the surrounding casing 28. Once engaged, the slips 42 resist downward movement of liner hanger 22 and liner 24. The gripping teeth 78 of each slip 42 may be positioned on a casing engagement pad 80, e.g. a wicker. In this example, the annular cone body 40 and the liner hanger slips 42 are mounted about an internal liner hanger body 82, e.g. a mandrel, which may be a tubular body having an internal longitudinal passageway 84 therethrough.

In FIG. 4, arrow 86 represents the direction of the hanging load exerted by the liner 24 and resisted by the liner hanger slips 42. For example, the load represented by arrow 86 may be transferred from liner hanger body 82 to the annular cone body 40, as represented by arrow 88. This loading is then transferred to liner hanger slips 42 through, for example, the engaged sloped surfaces as represented by load arrow 90. The load force represented by arrow 90 effectively transfers a lateral loading from the liner hanger slips 42 and into the corresponding casing 28, as represented by arrow 92. Consequently, the liner hanger 22 is able to support the weight of liner 24 suspended from liner hanger body 82 of liner hanger 22. In the example illustrated, the load 88 is transferred from liner hanger body 82 to annular cone body 40 via an abutment 94 formed along the external side of liner hanger body 82. In some embodiments, a bearing assembly 96, e.g. a bearing ring or rings, may be positioned between abutment 94 and annular cone body 40.

Figure 5:
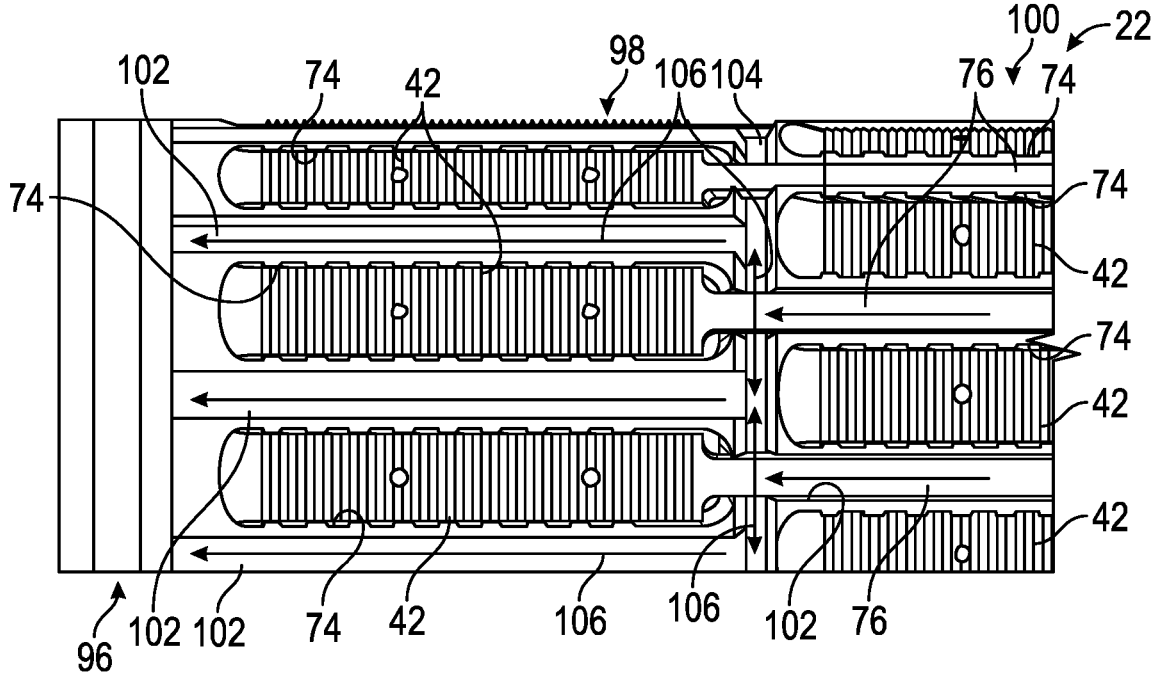
FIG. 5 is a side view of a portion of a liner hanger illustrating an example of staggered slips, according to an embodiment of the disclosure.

With additional reference to FIG. 5, the slips 42 and the corresponding slip slots 74 are illustrated in an example of a staggered arrangement to distribute loading through the annular cone body 40 and casing 28. In the embodiment illustrated, the slots 74 are positioned in the annular cone body 40 in a first group 98 of slots 74 and a second group 100 of slots 74. The second group 100 is located at a different longitudinal position along the annular cone body 40 relative to the first group 98. In this embodiment, the second group 100 also is located at a different circumferential position relative to the first group 98, e.g. slots 74 of the second group 100 may be positioned at a circumferential midpoint relative to pairs of slots 74 in the first group 98. The slips 42 are received in their corresponding slots 74 in the same staggered arrangement with a first band of slips 42 in the first group 98 and a second band of slips 42 in the second group 100. In this arrangement, the arms 76 of the slips 42 in the first band extend between the slips 42 of the second band, e.g. along the circumferential space between pairs of slips 42 in the second band.

The liner hanger cone 38, e.g. annular cone body 40, also may be provided with fluid flow channels to enable fluid flow along the liner hanger cone 38. For example, a longitudinal fluid flow channel 102, e.g. a plurality of longitudinal fluid flow channels 102, may be routed along the annular cone body 40, as illustrated. Some of the longitudinal fluid flow channels 102 may be positioned between pairs of slots 74 and other longitudinal fluid flow channels 102 may be located beneath arms 76 of corresponding slips 42. For example, when the slips 42 are shifted radially outward and into engagement with the surrounding casing 28 space, e.g. a gap, is created beneath the corresponding slip arms 76 to accommodate fluid flow.

In the illustrated example, the fluid flow channels also comprise at least one annular fluid flow channel 104 extending at least partially along the circumference of annular cone body 40. The annular fluid flow channel(s) 104 is in fluid communication with longitudinal fluid flow channels 102 as indicated via flow arrows 106. By way of example, the annular fluid flow channel 104 may be located longitudinally between the first group 98 and the second group 100 of slots 74, thus longitudinally spacing the first group 98 from the second group 100. The circumferential space between engagement pads 80 of slips 42 can be minimized to increase the number of slips 42 that are positioned circumferentially around the annular cone body 40, provided fluid flow is not detrimentally restricted.

Figure 6:
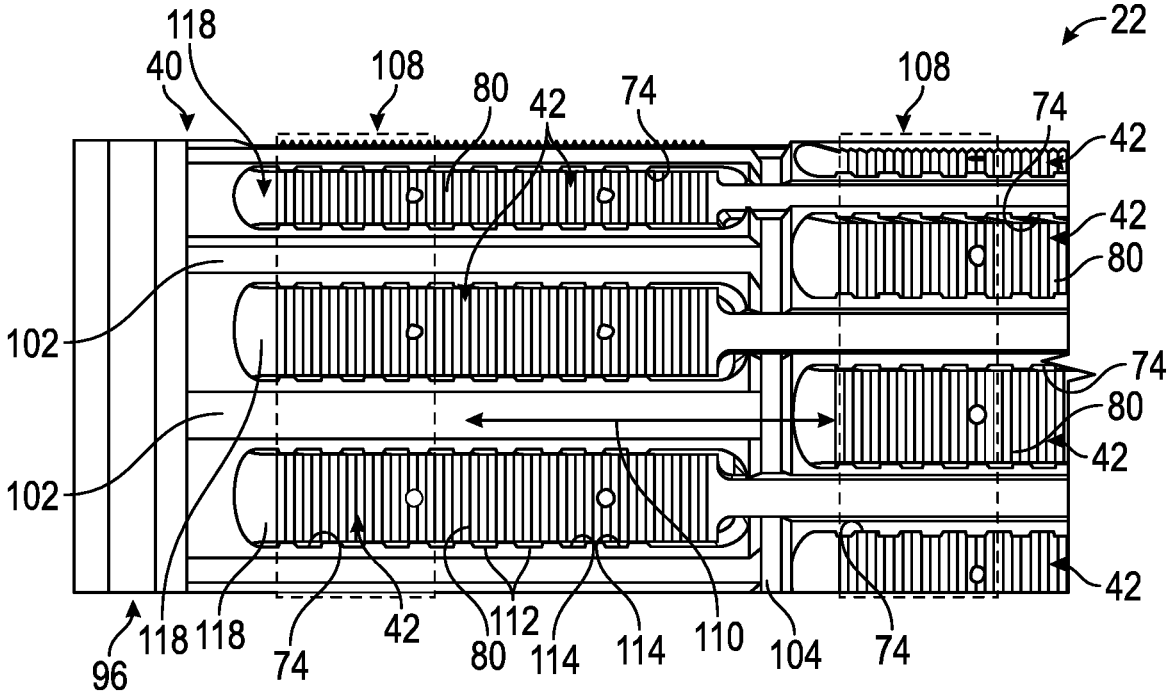
FIG. 6 is a side view of a portion of a liner hanger illustrating an example of staggered slips and distributed loading zones created by engagement of the slips with a surrounding pipe, e.g. casing, according to an embodiment of the disclosure.

Staggering the liner hanger slips 42 enables an overlap of slip engagement areas, thus increasing the number of slips 42 located circumferentially around the annular cone body 40. However, the increase in number of slips 42 does not detrimentally affect the desired minimum flow bypass area. The flow bypass area can be used for cement bypassing the liner hanger 22 through the annulus between the liner hanger 22 and the casing 28. The staggering of slips 42 also enables the load transferred to the casing 28 to be distributed over a plurality of zones 108, e.g. two zones, as illustrated in FIG. 6. The plurality of zones 108 facilitates distribution of the hanging load to casing 28. The distributed loading can help maintain the integrity of both the casing 28 and the annular cone body 40. For example, distribution of loading helps to reduce overall stresses in the slips 42 and annular cone body 40, e.g. stresses in the engaged loading ramps and splines as described in greater detail below.

Referring again to FIG. 6, the staggered configuration of slips 42 and corresponding slots 74 effectively provides a division in load path. This divided load path enables accommodation of a greater number of slips 42 to help reduce load occurring between the slips 42 and casing 28. Anchoring the slips 42/annular cone body 40 at, for example, two different zones 108 allows the material between the two loading zones 108 to load in tension, as represented by arrow 110. The reactive force acting from the annular cone body 40 to the slips 42 redistributes the load path to help ensure that the distributed load on each guide spline 112 is balanced (see also FIGS. 7-10).

Figure 7:
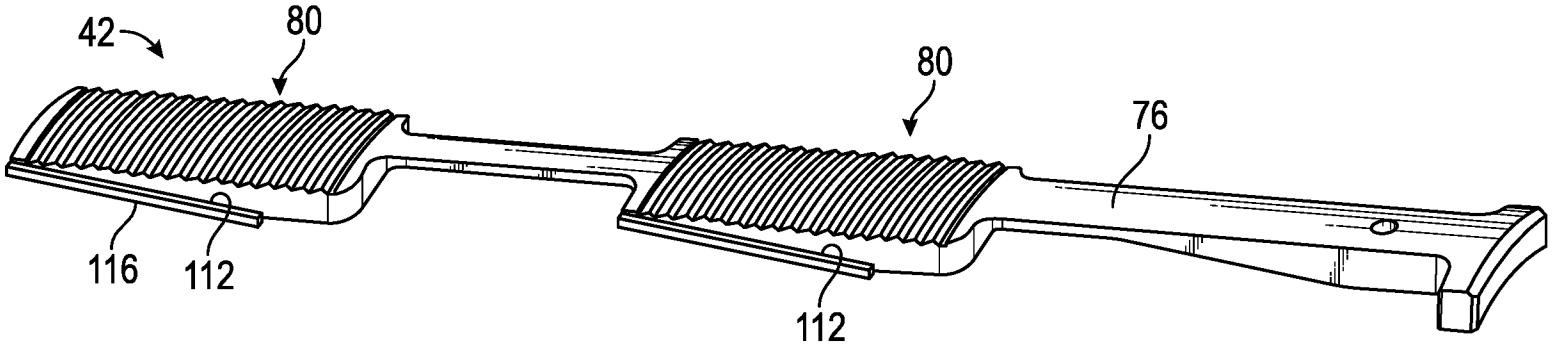
FIG. 7 is an illustration of another example of a slip which may be used with the liner hanger, according to an embodiment of the disclosure.

With additional reference to FIG. 7, another embodiment of slip 42 is illustrated. In this embodiment, the slip 42 comprises a plurality of engagement pads/wickers 80, e.g. two engagement pads. The plurality of engagement pads 80 can be used to further distribute loading or to provide a desired loading pattern between the slips 42 and casing 28. In some applications, slips 42 with plural engagement pads 80 also can be circumferentially staggered as illustrated in FIG. 6.

Whether each slip 42 has a single engagement pad 80 or a plurality of engagement pads 80, the slip 42 also may comprise at least one spline 112 positioned to engage a corresponding guide spline 114 located along the corresponding slot 74 of annular cone body 40. Each slip 42 also may comprise a sloped engagement surface 116 oriented for engagement with a corresponding sloped ramp 118 positioned on annular cone body 40 (see also FIGS. 8-10). The sloped ramps 118 may be located at longitudinal ends of corresponding slots 74. When the actuator 44 forces the slips 42 in a longitudinal direction along annular cone body 40, the sloped ramps 118 and corresponding guide splines 114 force the slips 42 in a radially outward direction and into engagement with the surrounding casing 28.

Figure 8:
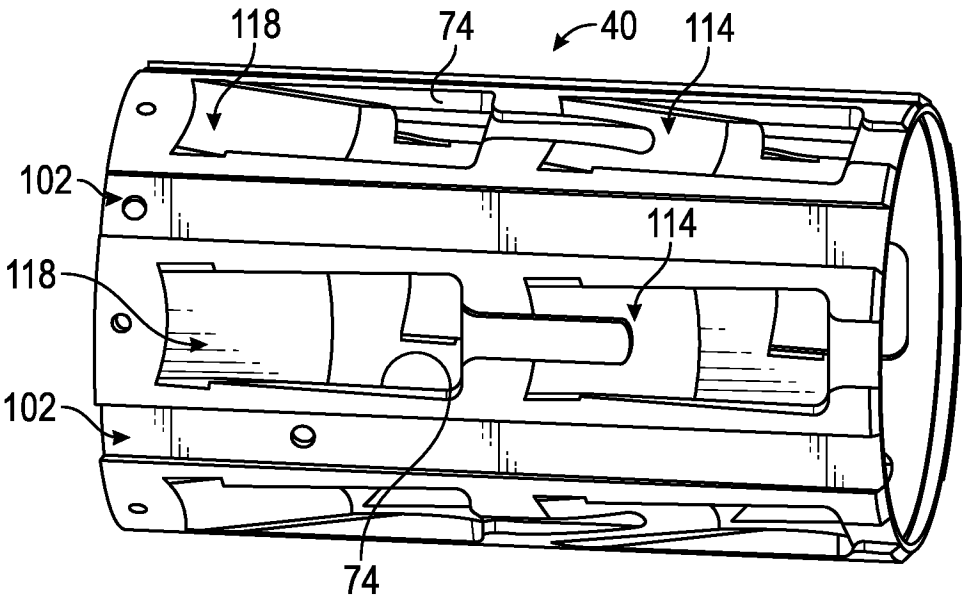
FIG. 8 is an illustration of an example of at least a portion of a liner hanger cone body which may be used with the liner hanger, according to an embodiment of the disclosure.

In FIG. 8, a portion of an embodiment of annular cone body 40 is illustrated as having sloped ramps 118 positioned to accommodate slips 42 with dual engagement pads 80. For example, the slip 42 illustrated in FIG. 7 may be used with the annular cone body 40 illustrated in FIG. 8. Additionally, this embodiment of annular cone body 40 may comprise corresponding guide splines 114 associated with each sloped load ramp 118. Longitudinal fluid flow channels 102 may be located between adjacent slip slots 74. Additionally, this embodiment of annular cone body 40 may have circumferentially staggered slots 74 as with the embodiment illustrated in FIG. 6.

Figure 9:
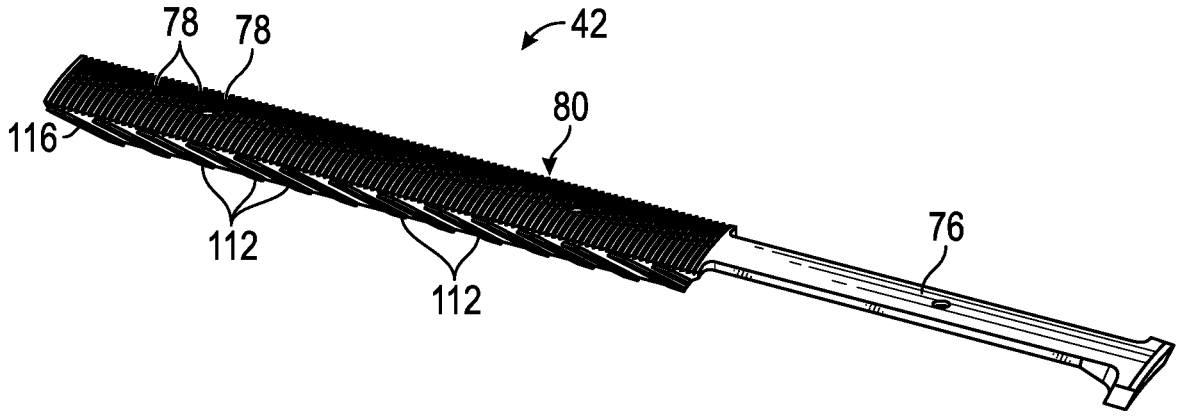
FIG. 9 is an illustration of another example of a slip which may be used with the liner hanger, according to an embodiment of the disclosure.
Figure 10:
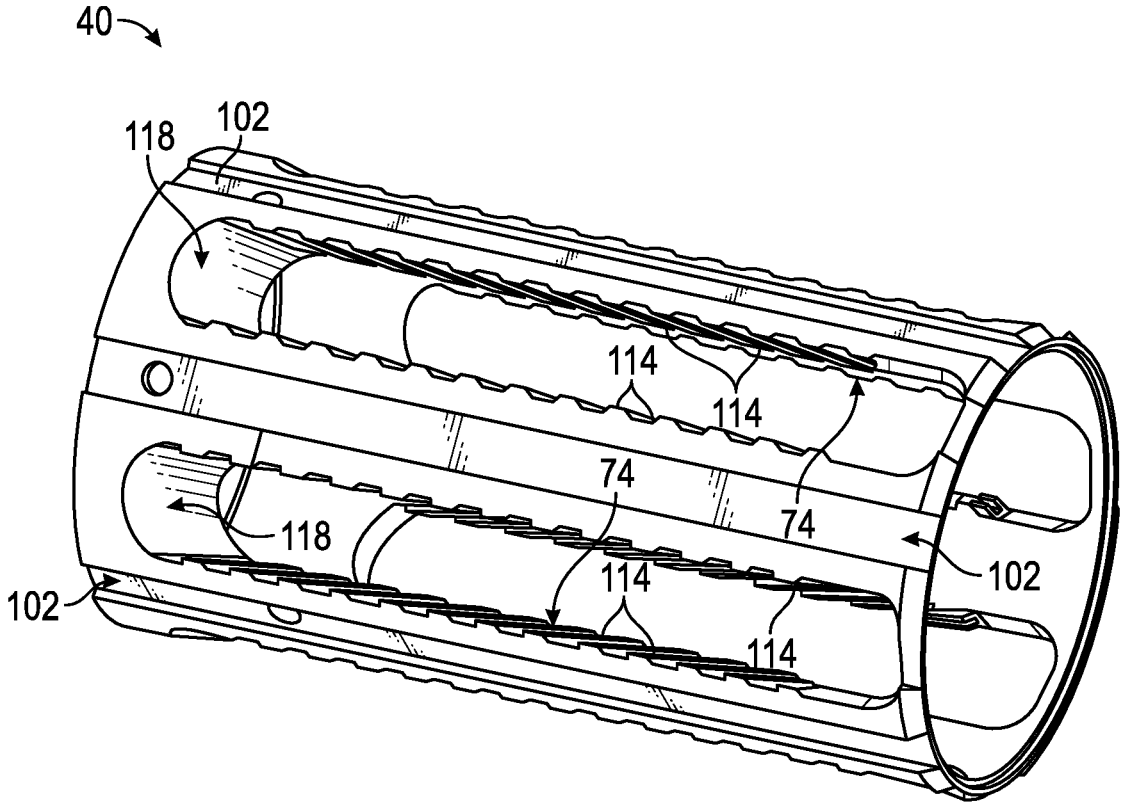
FIG. 10 is an illustration of another example of at least a portion of the liner hanger cone body which may be used with the liner hanger, according to an embodiment of the disclosure.

An embodiment of slip 42 having a single engagement pad/wicker 80 and of annular cone body 40 constructed to receive such a slip 42, is illustrated in FIGS. 9 and 10, respectively. In this example, the slip 42 has at least one spline 112, e.g. a plurality of splines 112, in the side area of engagement pad 80. The corresponding annular cone body 40 is constructed with a single corresponding sloped load ramp 118 at the end of each slot 74. Additionally, the annular cone body 40 comprises at least one corresponding guide spline 114, e.g. a plurality of corresponding guide splines 114, which work in cooperation with the splines 112. The load ramps 118 work in cooperation with sloped engagement surfaces 116 and the corresponding guide splines 114 work in cooperation with the splines 112 to force the slips 42 radially outward into engagement with casing 28 when shifted by actuator 44. As with the embodiments described above, fluid flow channels, such as longitudinal flow channels 102, may be positioned along the annular cone body 40. Additionally, this embodiment of annular cone body 40 may have circumferentially staggered slots 74 as with the embodiment illustrated in FIG. 6.

It should be noted the slots 74 and slips 42 may be staggered according to a variety of patterns to provide a desired load distribution with respect to casing 28. Furthermore, the liner hanger 22 may comprise a variety of additional or other features depending on the parameters of a given operation. The construction of slips 42 and liner hanger cone 38 also may be changed to accommodate various downhole operations. Similarly, the liner hanger 22 may be combined with a variety of running strings, liners, and other components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a borehole, comprising:

a liner hanger having:

an annular cone body comprising a first group of slots and a second group of slots, the second group of slots being located at a different longitudinal position along the annular cone body relative to the first group of slots; and a plurality of slips comprising a first band of slips movably received in the first group of slots and a second band of slips movably received in the second group of slots, the second band of slips being circumferentially staggered relative to the first band of slips, wherein each slip of the first band of slips comprises an arm disposed between two slips of the second band of slips, wherein the annular cone body comprises longitudinal fluid flow channels, wherein the longitudinal fluid flow channels comprise at least one longitudinal fluid flow channel between pairs of slots of the first and second group of slots and at least one longitudinal fluid flow channel located beneath the arm of a corresponding slip of the first band of slips.

2. The system as recited in claim 1, wherein the first group of slots and the second group of slots are longitudinally separated.

3. The system as recited in claim 1, wherein each slip of the plurality of slips comprises a casing engagement pad.

4. The system as recited in claim 1, wherein each slip of the plurality of slips comprises a plurality of casing engagement pads.

5. The system as recited in claim 1, wherein each slip of the plurality of slips comprises a spline positioned to engage a corresponding guide spline on the annular cone body.

6. The system as recited in claim 1, wherein the annular cone body comprises an annular fluid flow channel in communication with the longitudinal fluid flow channels.

7. The system as recited in claim 1, further comprising a liner coupled to the liner hanger.

8. A system, comprising:

a liner hanger having:

a single liner hanger cone in a form of an annular cone body portion comprising a first end and a second end;

a first band of slips disposed proximate to, and around, the first end of the annular cone body portion; and a second band of slips disposed proximate to the first band of slips on the single liner hanger cone and disposed around the annular body such that the slips of the second band of slips are at a different longitudinal position and circumferentially staggered relative to the slips of the first band of slips, wherein each slip of the first band of slips has an arm extending between two slips of the second band of slips, the system further comprising at least one longitudinal fluid flow channel located beneath the arm of a corresponding slip of the first band of slips.

9. The system as recited in claim 8, wherein each slip of the first band of slips includes a wicker.

10. The system as recited in claim 8, wherein each slip of the first band of slips has at least one spline that engages a guide spline disposed on the annular body portion.

11. The system as recited in claim 8, wherein each slip of the second band of slips includes a wicker.

12. The system as recited in claim 8, wherein each slip of the first band of slips is spaced apart from each next adjacent slip of the first band of slips by a fluid flow bypass area.

13. The system as recited in claim 8, wherein the annular cone body portion comprises a channel disposed about a periphery of the annular cone body portion between the first band of slips and the second band of slips to accommodate fluid flow.

14. A method, comprising:

providing a liner hanger cone comprising: longitudinal flow channels; a first group of slip slots; and a second group of slip slots, the second group of slip slots being located at a different longitudinal position along the liner hanger cone relative to the first group of slip slots;

movably receiving a plurality of slips comprising a first band of slips in the first group of slip slots, and a second band of slips in the second group of slip slots, the second band of slips being longitudinally and circumferentially staggered relative to the first band of slips, to form a liner hanger, wherein each slip of the first band of slips comprises an arm disposed between two slips of the second band of slips;

routing at least one longitudinal fluid flow channel of the longitudinal flow channels between pairs of slip slots of the first and second group of slip slots; and locating at least one longitudinal flow channel of the longitudinal flow channels beneath the arm of a corresponding slip of the first band of slips; and coupling the first band of slips and the second band of slips to an actuator to enable actuation of the first and second bands of slips during setting of the liner hanger.

15. The method as recited in claim 14, further comprising actuating the first and second bands of slips into engagement with a casing at a downhole location in a wellbore.

* * * * *